US005520135A

United States Patent [19]

Rolland et al.

[11] Patent Number: 5,520,135

[45] Date of Patent: May 28, 1996

[54] METHOD AND APPARATUS FOR HOISITNG HANDLING OF A LOAD AT SEA

[75] Inventors: Yves Rolland, Epinay sur Orge; Alain Nizou, Toulon, both of France

[73] Assignee: France Telecom, Paris, France

[21] Appl. No.: 247,062

[22] Filed: May 20, 1994

[30] Foreign Application Priority Data

May 27, 1993 [FR] France ..... 93 06677

[51] Int. Cl.[6] ..... B63B 27/08

[52] U.S. Cl. ..... 114/254; 114/210; 114/259; 114/366; 414/137.7

[58] Field of Search ..... 114/210, 253, 114/254, 365, 366, 259; 414/137.7, 564; 212/147

[56] References Cited

U.S. PATENT DOCUMENTS

| | | | |
|---|---|---|---|
| 2,916,162 | 12/1959 | Gercke | 212/147 |
| 3,577,951 | 5/1971 | Smith | 114/210 |
| 3,889,621 | 6/1975 | Pease | 114/210 X |

FOREIGN PATENT DOCUMENTS

| | | |
|---|---|---|
| 2174147 | 10/1973 | France . |
| 4127449 | 2/1993 | Germany . |
| 1231486 | 5/1971 | United Kingdom . |

*Primary Examiner*—Sherman Basinger
*Attorney, Agent, or Firm*—Dvorak and Traub

[57] ABSTRACT

An apparatus installed on board any maritime support for hoisting and handling loads at sea, the apparatus having at least one winch on which a cable is wound that enables the load to be raised, a gantry carrying suspension systems for the cable, and enabling the cable together with the load to be moved overboard relative to an edge of the maritime support in order to launch the load, and any fixed guidance and deflection systems close to the edge of the support and capable of receiving the cable after the launching and while the load is in use. The gantry is a fixed structure constituted by at least one continuous displacement system for a carriage carrying the cable suspension system and interconnecting at least two points, with a vertical line from one of the points passing through the support and a vertical line from the other support being overboard relative thereto, the two points defining a straight line segment that intersects at a point another straight line segment defined as interconnecting the winch and the guidance and deflection systems.

11 Claims, 4 Drawing Sheets

METHOD AND APPARATUS FOR HOISITNG HANDLING OF A LOAD AT SEA

DESCRIPTION

The present invention relates to a method and an apparatus for hoisting handling of a load at sea.

The technical field of the invention is that of making handling gantries and devices suitable for installation on board any kind of maritime support.

One of the main applications of the invention lies in operating undersea vehicles at sea, such as a plow, tractors, remotely-controlled robots, etc. . . . , that generally remain connected to a surface support such as a ship, a platform, etc. . . . , via one or more cables such as a towing cable, a hoisting cable, a remote control cable, a power supply cable, etc. . . . .

It would also be possible to envisage other applications, possibly even on land, in which a load transfer device in accordance with the invention could satisfy objects such as those defined and developed below, particularly in the maritime field, for which the characteristics of the present invention are more pertinent, and provide the best solutions to the problems specifically raised by handling loads at sea.

BACKGROUND OF THE INVENTION

Two categories of system are known for that purpose, namely:

those that provide handling from the deck of a maritime support to the outside of said support, in discontinuous manner, with first means comprising a set of winches, cables, and gantries enabling the load to be raised off the deck of the ship and then moved overboard therefrom, and finally put into the water, and another means comprising a second set of winches and cables for implementing all of the operations that take place at sea or underwater: which systems require one of the means to take over the load from the other, and for that purpose it is necessary to make use either of divers who perform the transfers (which is dangerous and chancy depending on the state of the sea), or else it is necessary for the two above-mentioned systems to be associated with additional mechanical devices that must also be provided on the loads proper, said devices serving to eliminate human intervention but often being very complicated, difficult to operate, and very large, particularly with increasing weight of the load; and those that perform both aspects of handling as defined above, i.e. both in the air and on or in the sea, in a single pass: such systems comprise special moving gantries having a large amount of clearance, of the order of 160° of oscillation about a horizontal axis secured to the support, and constituted by a structure that is thus driven about said axis by at least four large actuators: naturally, such gantries are very heavy, very bulky, and pose problems firstly of stability of the ships carrying them, and secondly of taking up forces at points that are highly localized and very close to the edges of such ships, thereby requiring specialized ships, and in addition they require very large investment costs.

The problem posed is to be able to perform two complementary functions that are both required for handling loads at sea, but which have opposing criteria and requirements, namely:

the function of using a load, in particular marine or submarine vehicles such as remotely-controlled vehicles, or plows, after they have been immersed; and the function of hoisting them from the deck of a support at sea until they are launched, and vice versa; and that must be done without using means that are too bulky, too heavy, or too complex to implement, or that require highly specialized devices, so as to avoid worsening the overall investment cost, while nevertheless providing both of the above functions with a high degree of safety and of effectiveness.

BRIEF SUMMARY OF THE INVENTION

One solution for the problem posed is an apparatus for hoisting and handling loads at sea from a surface maritime support, said apparatus being capable of transporting said load, including at least one winch on which a cable is wound that enables said load to be raised, and a gantry carrying any circulary symmetrical suspension means for said cable such as a deflection pulley, and enabling the cable together with said load to be moved overboard relative to an edge of said maritime support in order to launch the load, and any fixed guidance and deflection means close to said edge of said support and capable of receiving said cable after said launching and while said load is in use, said gantry being a fixed structure constituted by at least one continuous displacement means for a carriage carrying said cable suspension means and interconnecting at least two points, with a vertical line from one of the points passing through said support and a vertical line from the other support being overboard relative thereto, said two points defining a straight line segment that intersects at a point another straight line segment defined as interconnecting said winch and said guidance and deflection means.

In a preferred embodiment, said fixed structure is S-shaped, having one end inboard of the support carrying the point and placed close to the deck of the support on which said load is supported, while the other end thereof carries the point and is situated overboard relative to the support, being placed higher than the deck and higher than the guidance and deflection means.

When it is desired to implement an additional power supply and/or remote control cable for said load in addition to the above-mentioned hoisting cable, in particular when the load is intended to perform under-sea work, it is then necessary to be able to clamp such an "umbilical" second cable to the hoisting cable, and for that purpose, according to the present invention, said hoisting cable winch is preferably situated close to a support deck in such a manner that the axis connecting said winch to said guidance and return means is close to said deck; and in a particular embodiment this is combined with an S-shaped gantry as mentioned above, thereby making it that much easier to implement.

To implement the above apparatuses, various method stages of the invention are described below and are illustrated by the figures in order to make it possible, in particular, to implement both of the functions as outlined above.

The result is novel methods and apparatuses for hoisting and handling a load at sea, satisfying the objects specified, and not suffering from the drawbacks of existing systems.

Apparatuses of the present invention make it possible to perform all of the handling stages in a single run without requiring a heavy structure to be motorized, without requiring human intervention in the water, and making it possible to use any load accompanying and/or locking system.

In addition, the various equipments required for implementing these apparatuses and the various methods required for performing them can be constituted by equipments that already exist on the maritime support structure, in particular such as winches, pulleys, or any other suspension, deflection, and guidance means, together with certain cables such as an anchor cable as are often to be found on board such a support.

The special equipment such as the fixed gantry described may be of a structure that can be dismantled, and taken off one ship for fitting onto another, depending on the looked-for type of use, since it does not require major adaptation of the hull of the ship.

While nevertheless enabling all of the handling stages to be performed in a single run without loads being taken over and without discontinuity between the launching and then the operating of such loads, and vice versa, the apparatuses and methods of the invention nevertheless dissociate in a manner that is novel and inventive firstly the function of operating the load once it is immersed and secondly the function of hoisting proper as applied to the load from its support, while nevertheless using the same means for engaging the hoisting cable between the load and the support, which is not possible with any equipment known in the past.

Under such circumstances, the above-defined hoisting operation proper can be performed during chosen periods of weather, and thus without inducing excessive forces in the handling system, unlike the operation of using the load, which operation either follows or precedes the hoisting operation, and can be performed even under difficult weather conditions, since the hoisting system for launching purposes is no longer being stressed: that is why it has been necessary until now either to overdimension all of the installations for hoisting and handling in order to withstand extreme conditions, or else to have two systems each adapted to its own particular operation, with the consequent load changing operation.

There is no doubt that in the field of handling on land, various apparatuses are known that include stationary structures also constituted by means for continuously displacing a load-carrying carriage, e.g. such as those described in European patent application EP 55 039 published on Nov. 18, 1979 under priority from a German application and relating to a "Conveyor system for load carriers provided with suspension hooks", and also from European application EP 126 716 published on Nov. 28, 1984 in the name of FIAT AUTO and entitled "Conveyor installation and suspension path for vehicle bodywork, and bodywork carrier for said installation", or indeed from French utility certificate No. 2 456 684 published on Dec. 12, 1980, claiming Italian priority, and entitled "Apparatus for transport by overhead or suspended rail, particularly applicable to slaughterhouses for transporting slaughtered animals".

Nevertheless, none of those apparatuses solves the problem of translation and of displacement optionally associated with a change in level for carrying a load from one point to another, which constitutes one of the hoisting functions required both at sea and as defined above; however such apparatuses do not mention the objective of satisfying the operational conditions proper of the load once it has been displaced from said point to another point, with it being possible to generate very large tension forces in the hoisting cable during use of the load, in particular because of the dynamic effects that can often be found at sea.

As mentioned in the introduction above, the apparatuses and methods of the present invention are nevertheless also applicable to applications on land, insofar as they give rise to the same problems as are to be found at sea, thus making it possible to use all of the characteristics of the invention: which characteristics are quite different from and well in excess of that which is known on land.

Other advantages of the present invention could be mentioned, but those mentioned above suffice to demonstrate the novelty and the advantages of the invention.

BRIEF DESCRIPTION OF THE DRAWINGS

The following description and figures show an embodiment of the invention given by way of non-limiting example: other embodiments are possible within the ambit of the scope and the extent of the invention, in particular by changing the shape and the implementation of the stationary structure constituting the support gantry for the moving carriage that supports the pulley for hoisting the load from the deck of the support until it projects overboard from the deck.

MORE DETAILED DESCRIPTION

Figure 1:
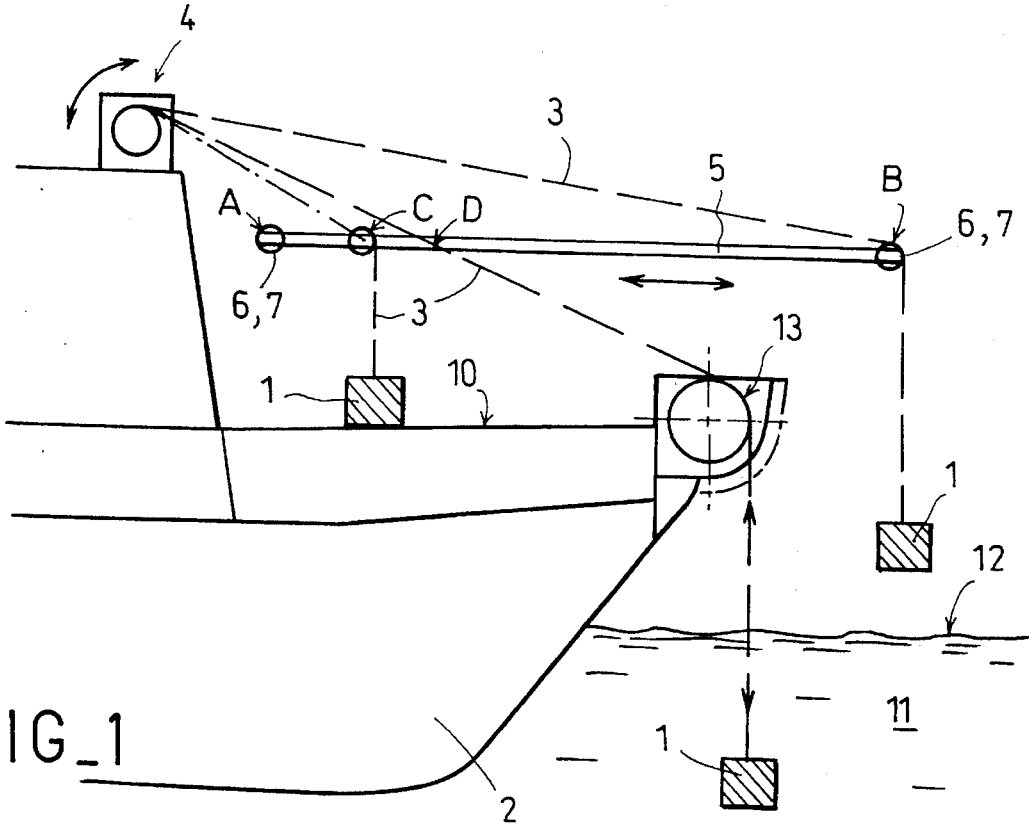
FIG. 1 is a diagrammatic elevation view of apparatus of the invention.

The apparatus of the invention for hoisting and handling a load at sea from a maritime surface support 2 that may either be a ship as shown in the figures or else a fixed platform, etc. . . . , and that is capable of transporting said load 1, comprises in a manner which is conventional and which may thus make use of equipment that already exists on said support: at least one winch 4 having a cable 3 wound thereon enabling said load 1 to be raised, a gantry 5 carrying any kind of suspension means, e.g. a pulley 7 for deflecting said cable 3 and enabling the cable together with said load 1 to be placed overboard relative to a side of said maritime support 2 in order to enable the load to be launched, and any guidance and deflection means 13 fixed close to the edge of said support 2 and capable of receiving said cable 3 after said launching and while said load 1 in use; these various equipments may thus already exist on the ship 2 except insofar as the gantry 5 will need to be modified or replaced by a special gantry as defined below and in accordance with the present invention; for example, the guidance and deflection means 13 may be constituted by the sheaves disposed at the bow of certain ships between two cheeks (or "bath tubs") 18 of the hull of the ship, as in cable ships for laying submarine cables: under such circumstances, the edge of the ship is vertically above the stem, but on other ships the load can be used from an area at the stern or over the side.

In accordance with the invention, the gantry 5 is a fixed structure constituted by at least one means for continuously moving a carriage 6 carrying said pulley 7, and which may be replaced by any other rotary suspension means such as a sheave, a davit, a roller, a curve of rollers, an hour-glass shaped pulley wheel, etc. . . . : said continuous displacement means interconnects at least two points A and B with a vertical line through one of the points, A, passing through the support 2, while a vertical line through the other point is overboard relative thereto, said two points A and B defining a straight line segment that intersects, at a point D, another straight line segment defined as interconnecting said winch 4 and said guidance and deflection means 13.

For this purpose, as shown by way of example in FIG. 1, said gantry 5 may be constituted by a beam that is at least continuous and rectilinear, e.g. a horizontal beam, and that is situated above the deck 10 of the ship 2 at a sufficient distance therefrom to enable the load 1 to be hoisted and transferred, in this case over the bow of the ship. The said winch 4 is then situated on a structure that is located above the straight line formed by the gantry 5 so that the straight line segment defined as interconnecting said winch with said guidance and deflection means 13 intersects said gantry 5 at a point D between its two ends A and B.

In order to avoid putting the winch 4 at too great a height, and thus in order to be able to place the straight line formed by the gantry 5 close to the deck 10, the gantry may be inclined so that its point A is closer to the deck 10 while the point B that is overboard remains at a height that is great enough to ensure that launching is possible.

Figure 2:
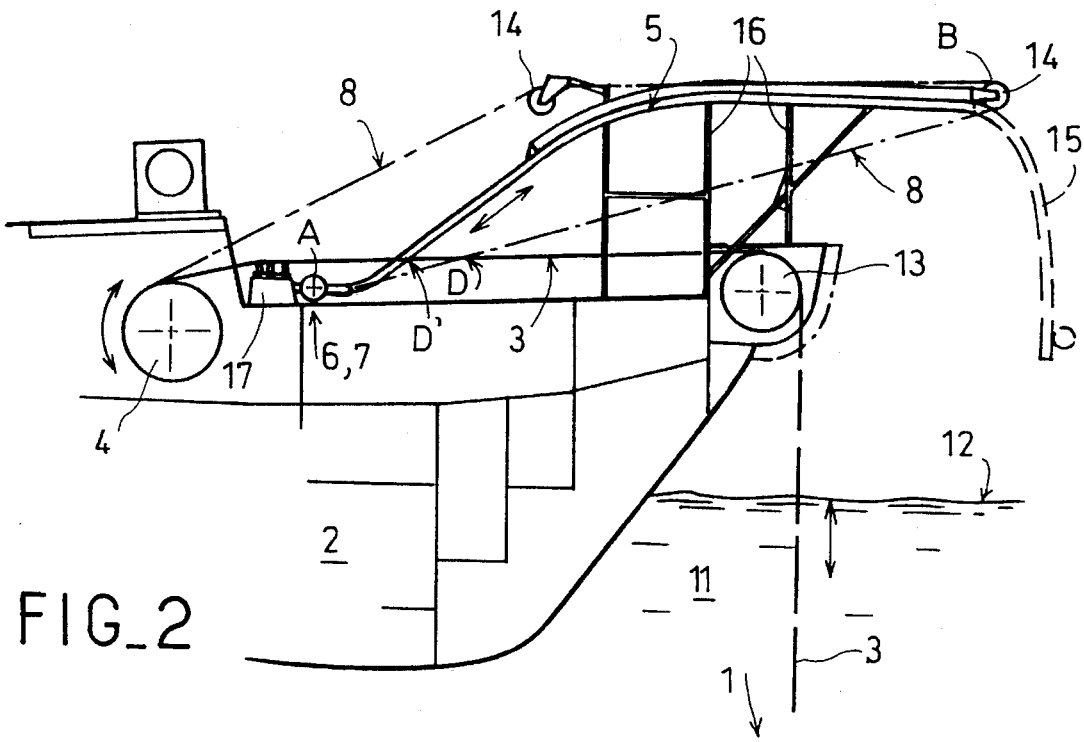
FIG. 2 is an elevation view of a particular embodiment of the apparatus of the invention.

FIG. 2 shows a preferred embodiment that makes it possible to combine both the advantage of having a gantry 5 that is inclined, as described above, and the advantage of clearing the area of deck 10 sufficiently without interfering excessively with said area: to do this, said fixed structure 5 is S-shaped, with one end situated inboard of the support 2 carrying the point A and being placed close to the deck 10 of the support that carries said load 1, while its other end carrying the point B is situated overboard relative to the support 2 and is placed higher than the deck 10 and the guidance and deflection means 13.

This S-shaped structure 5 then intersects the axis interconnecting the winch 4 and the means 13 at a point D'.

Figure 6:
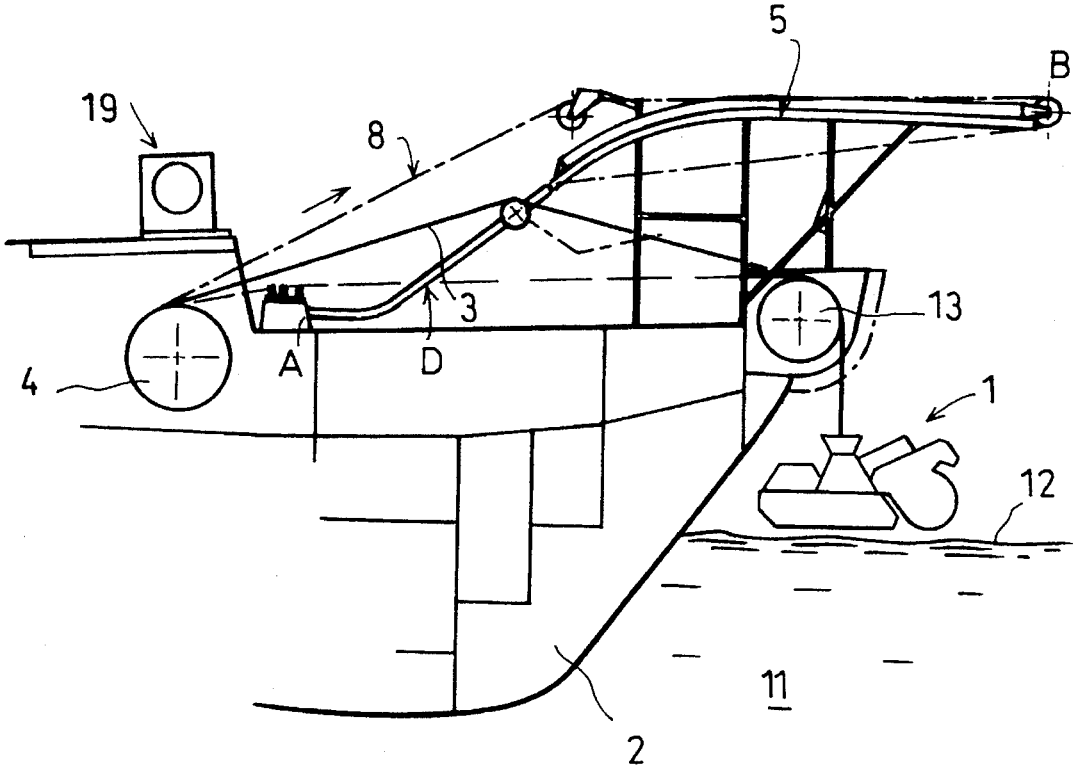
Figure 7:
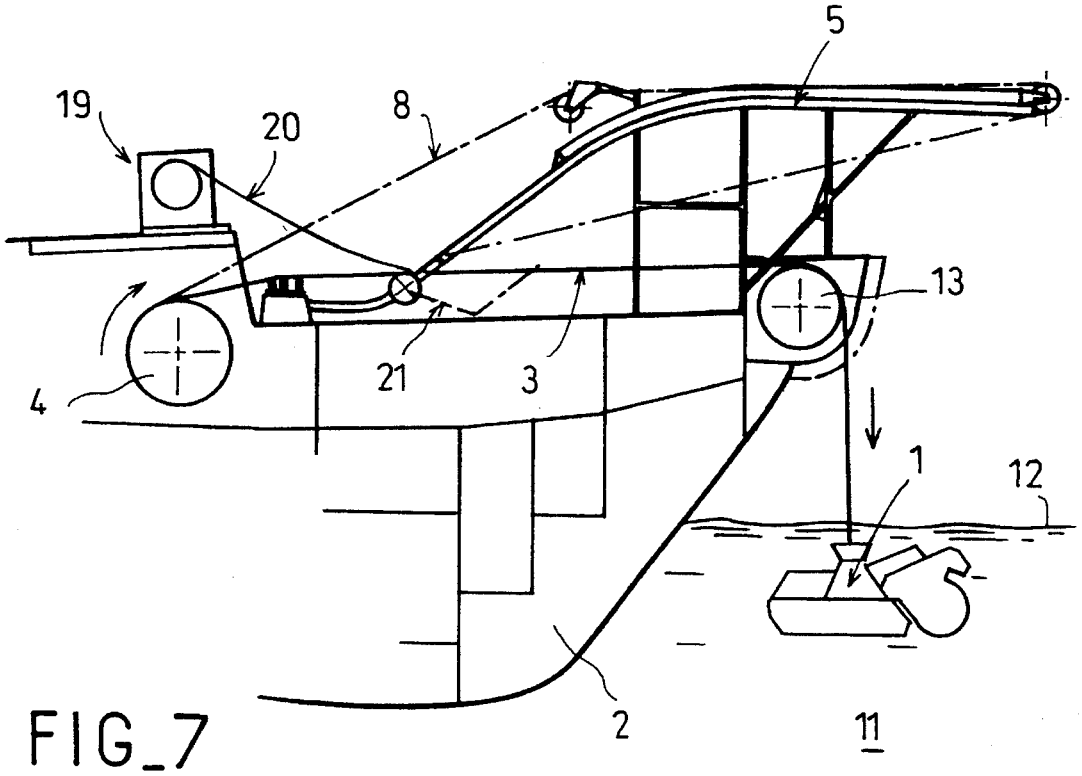

The said winch 4 can thus be situated close to said deck 10, or close to some other deck of the support 2, such that the axis interconnecting the winch to said guidance and deflection means 13 for the cable 3 is close to said deck 10. In particular, as explained above, this makes it possible in operation during use of the load to clamp an umbilical cable thereto relatively easily for the purposes of supplying power and/or remotely controlling the load 1 when it comprises an operational device or vehicle, said umbilical cord being paid out from a winch 19, for example, as shown in FIGS. 6 and 7.

Figure 3:
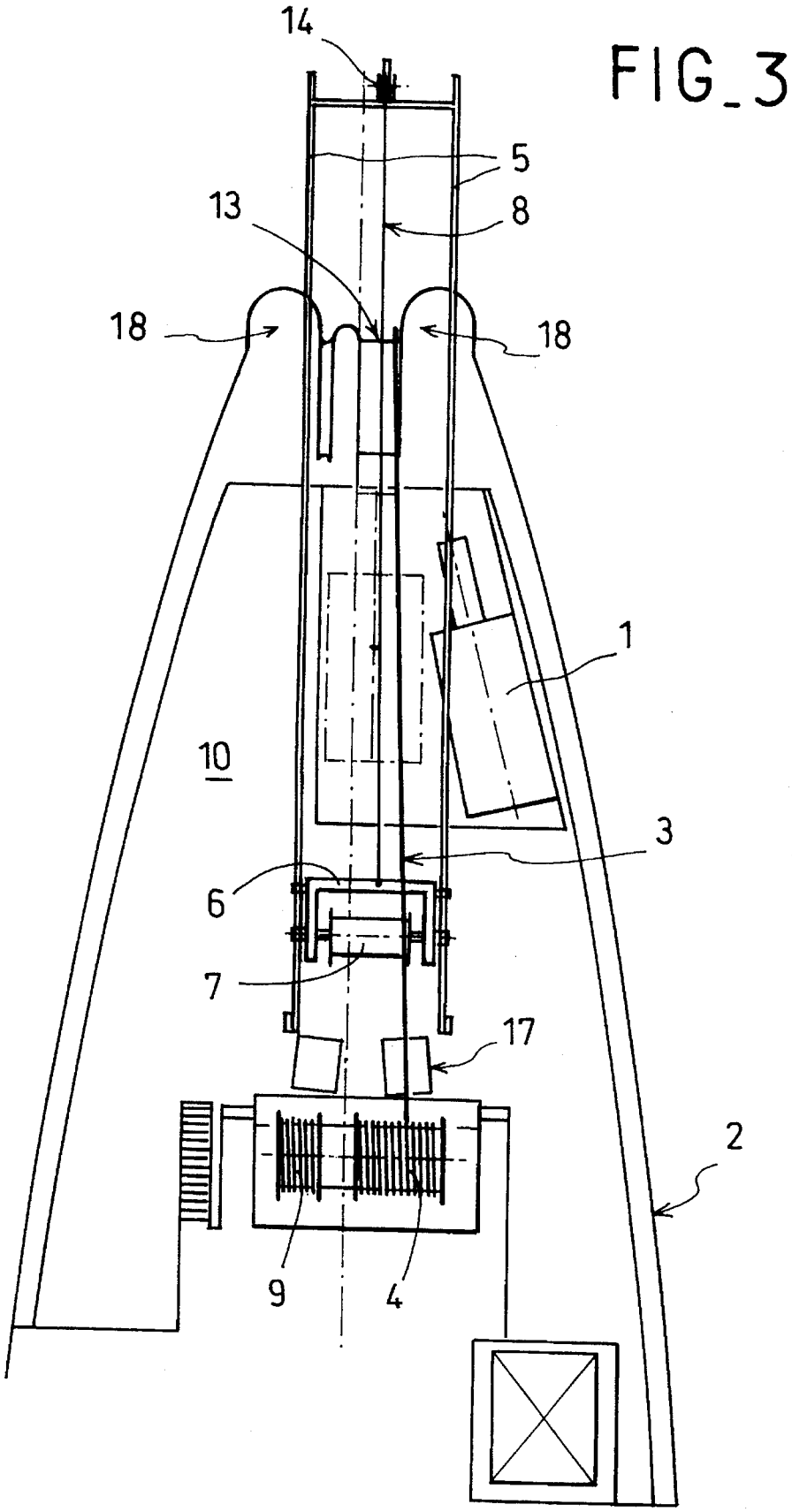
FIG. 3 is a plan view of the same apparatus as shown in FIG. 2.
Figure 4:
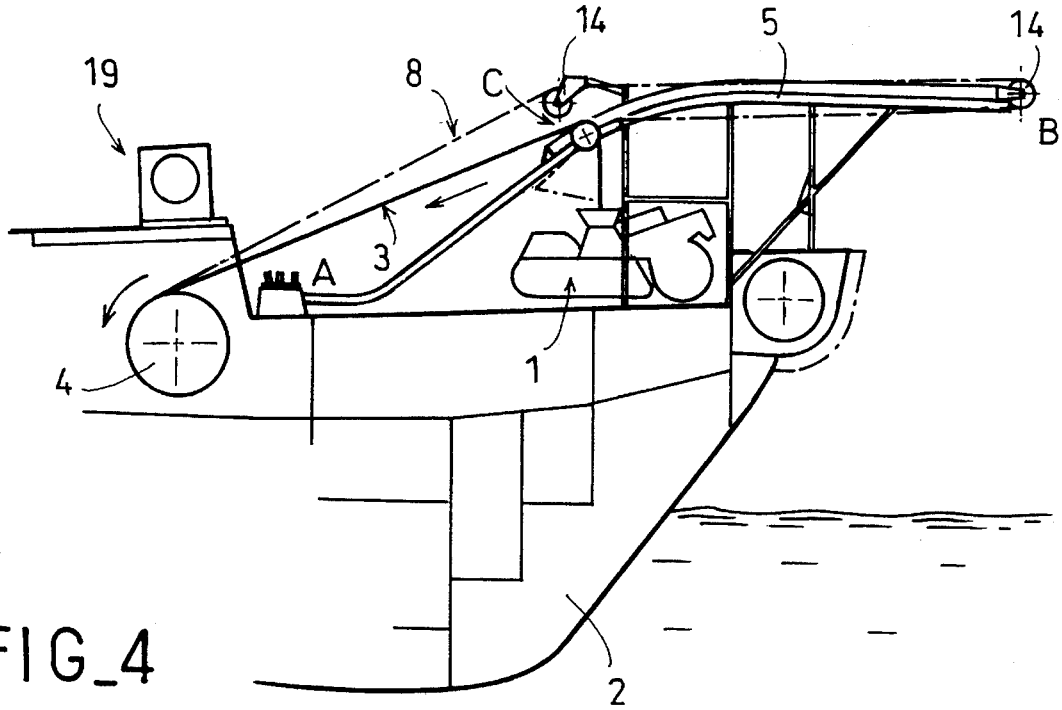
FIGS. 4 to 7 are diagrams showing the main stages of the method of the invention using, for example and preferably, a particular apparatus of the kind shown in FIG. 2.

In FIG. 3, said fixed structure 5 may be constituted by at least two guide rails on which there moves said carriage 6 carrying said suspension point for the cable, e.g. a pulley 7. The pulley receives the hoisting cable 3 from the hoisting winch 4 between the two guide rails of the gantry 5. Said carriage 6 that moves overhead may also include a rotary device through which said cable 3 also passes and serving to orient the load 1 relative to the gantry 5 depending on needs and requirements, e.g. during a hoisting stage as shown in FIG. 4, and/or during the following or preceding stage of moving the load overboard.

In an embodiment as shown in FIG. 2 et seq., said carriage 6 carrying said pulley 7 is driven in displacement along the continuous structure 5 by at least one traction cable 8 guided by deflection pulleys 14 and coming from any means 9 for driving said cable, such as a winch 9, for example. This means is optionally coupled to the same shaft and driving means as the hoisting winch 4 of the cable 3, as is to be found on various existing ships.

Said cable 3, once in the operative position for working the load 1, i.e. in a straight line between the winch 4 and the deflection means 13, and preferably close to one of the decks 10 of the ship 2, is then placed in said position against a device 17 for measuring tension.

The fixed gantry 5 is supported by a structure 16 for taking up the hoisting forces, but, as mentioned before, without requiring sampling capable of withstanding forces during bad weather that give rise, in particular, to pounding movements, since handling of the load 1 in air can be performed during selected periods of favorable weather, with the load being capable of waiting underwater or on deck.

If, over and above the considerations mentioned above, it is desired to limit certain forces and movements during the air-borne stage, said gantry 5 may be extended by an extension 15 beyond its overboard point B so as to come down closer to the surface 12 when launching the load 1, thereby avoiding perpendicular movement that can give rise to dynamic forces in the gantry.

In addition, said carriage 6 for overhead translation may include a compensator device 21 for compensating swinging motion with the said cable 3 passing through said device which enables movements of the load 1 to be damped while it is being launched or taken out of the water, and throughout all the rectilinear displacement motion thereof along the gantry 5.

As shown in the various figures, the carriage 6 may be displaced by a traction cable 8 passing over various deflection pulleys 14 that enable the cable to be kept clear of the load handling system proper and of the gantry 5. However, it would also be possible to use translation systems based on actuators, chains, or continuous cables, integrated along the rails of the structure 5 and enabling back-and-forth motion, or by systems involving motorizing the carriage 5 itself.

In similar manner, the load hoisting winch 4 fitted with the cable 3 may optionally be incorporated in the handling structure, however if such a winch and cable enabling the invention to be performed already exists on a ship, then that is naturally not necessary.

FIGS. 4 to 7 show and describe the method implemented by apparatus of the kind described above, in a particular embodiment thereof, in which in any event, there is a gantry 5 constituted by a fixed structure having at least one means for continuously displacing the carriage 6 carrying said suspension means or pulley 7 and interconnecting at least the two above-defined points A and B while passing through a point of intersection D' interconnecting said winch 4 and said guidance and deflection means 13.

In FIG. 4, the said carriage 6 is placed vertically above the load 1 standing on a deck 10 of said support 2, i.e. at a point C situated between said two points A and B, and said load is raised by applying drive from the drum 4 to the cable 3 as supported by the suspension means 7. As shown in FIG. 3, said load 4 may be stored before and after operation close to an edge of the support 2 while remaining clear of the underside of the gantry proper 5, e.g. so as to enable said gantry to handle other loads.

Figure 5:
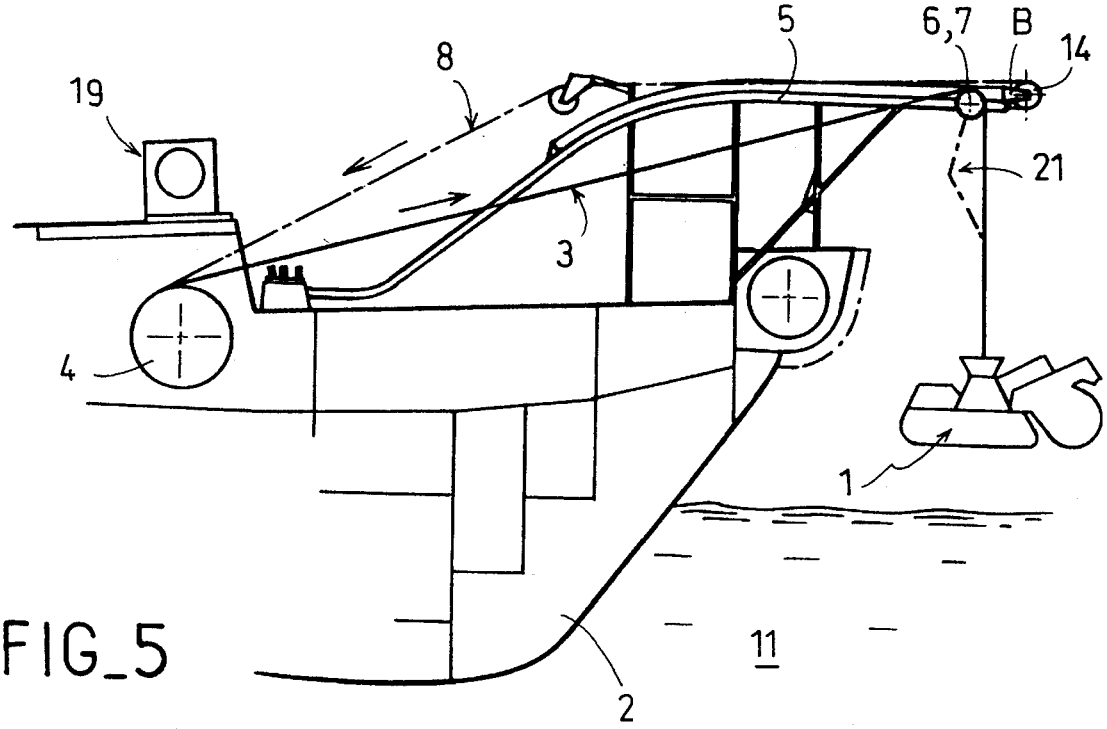

As shown in FIG. 5, said carriage 6 is displaced towards the point B until said load 1 has been moved far enough overboard from the support 2, and said cable 3 is paid out from the winch 4 so as to lower said load towards the surface 12 of the sea 11.

In FIG. 6, said carriage 6 is returned towards point A until it has gone through the point of intersection D' making it possible firstly to bring the cable 3 to bear against the guidance and deflection means 13, and then to disengage the cable 3 from the suspension means or pulley 7.

In FIG. 7, said load 4 is being handled by means of the cable 3 passing directly from the winch 4 to the guidance and deflection means 13 along the axis interconnecting them. It is in this position that it is possible, depending on the type of use, to clamp an umbilical cord 20 for powering and/or remotely controlling the load 1, which load may, for example, be a vehicle for handling or for burying a cable: said umbilical cable 20 may be paid out from a winch 19 that can be located anywhere on the maritime support 2, but that is preferably located in line with the cable 3 so as to facilitate said clamping from the deck 10.

Subsequently, when it is desired to raise said load 1 after operation and once it has performed the work required of it, the following operations are performed that are the inverse of those described above, namely:

with said load 1 in the water and supported by the cable 3 passing directly from the winch 4 and over the guidance and deflection means 13, said carriage 6 is brought towards the point A, going beyond the point of intersection D', thereby making it possible initially to allow the suspension means or pulley 7 to take up the cable 3 again, after which the cable can be disengaged from the guidance and deflection means 13;

the carriage 6 is moved overboard relative to the support 2 through the desired distance and the load 1 is hoisted by driving the winch 4 until the load has been raised above the deck 10 of the support 2; and the carriage 6 is returned towards the point A until it reaches a position C for storage of the load 1, which load is then put down on said deck 10.

We claim:

1. A method of hoisting and handling a load at sea from a maritime support on the surface, capable of transporting said load and carrying at least one winch on which a cable suitable for raising said load is wound, a gantry carrying a suspension means for said cable and enabling the cable to be moved overboard together with said load relative to an edge of said maritime support in order to enable the load to be launched, and any guidance and deflection means fixed close to said edge of said support and capable of receiving said cable after said launching, and throughout use of said load, the method comprising steps of:

providing a structure above said gantry and then securing said winch thereto such that said winch is above said gantry;

displacing a carriage carrying said suspension means on a fixed structure of the gantry;

moving said carriage between at least two points, with a vertical line issued from an inboard point A and passing through said support and a vertical line issued from the other point B being overboard relative to said support, said points A and B defining a line segment therebetween; and intersecting at a point D along said line segment connecting said two points A and B with a second line segment defined by a line segment interconnecting said winch and said guidance and deflection means, the intersecting point D being between the winch and the deflection means.

2. A method of hoisting and handling a load at sea, according to claim 1 and further comprising the steps of:

positioning said carriage vertically above the load placed on a deck of said support, at a point C situated between said two points A and B and said load is raised by the winch acting on the cable that is supported by the suspension means;

displacing said carriage towards the overboard point B until said load is located far enough overboard relative to the support, and said cable is paid out from the winch to lower said load towards th surface of the sea;

returning said carriage towards the inboard point A at least until it has gone past a point D', located at the intersection between the structure of the gantry and the second line segment which interconnects said winch and said guidance and deflection means, thereby making it possible in a first stage to cause the cable to engage said guidance and deflection means, and in a second stage to disengage the cable from the suspension means; and causing said cable to be placed in said second stage wherein said load is handled by means of the cable passing directly from the winch via the guidance and deflection means along the second line segment interconnecting them.

3. A method according to claim 2, and further comprising the steps of:

positioning said carriage over said load, wherein said winch is used to raise the load;

displacing the carriage and load overboard and allowing the cable to be played out until the load is launched;

once said load has been launched and is supported by the cable passing directly from the winch over the guidance and deflection means, said carriage is brought towards the inboard point A going beyond the intersection point D thereby making it possible in a first stage to return the cable to the suspension means, and in a second stage to disengage the cable from the guidance and deflection means;

moving the carriage overboard relative to the support through a desired distance and then hoisting the load by acting on the winch until the load has been hoisted above the deck of the support; and returning the carriage towards the inboard point A to a position for storing the load, which load is then lowered onto said deck.

4. An apparatus for hoisting and handling loads at sea from a surface maritime support, said apparatus being capable of transporting said load, including at least one winch on which a cable is wound that enables said load to be raised, and a gantry carrying suspension means for said cable, and enabling the cable together with said load to be moved overboard relative to an edge of said maritime support in order to launch the load, and any fixed guidance and deflection means close to said edge of said support and capable of receiving said cable after said launching and while said load is in use, wherein said gantry is a fixed, S-shaped structure constituted by at least one continuous displacement means for a carriage carrying said cable suspension means and interconnecting at least two points A and B, with a vertical line from one inboard A of the points passing through said support and a vertical line from the other point B being overboard relative to said support, said two points A and B defining a line segment there between that intersects at a point D along said line segment with a second line segment, said second line segment defined a line segment interconnecting said winch and said guidance and deflection means, the intersecting point D being between the winch and the deflection means, wherein said S-shaped structure has one end inboard of the support carrying the inboard point A and placed close to the deck of the support on which said load is supported while the other end thereof carries the outboard point B and is situated overboard relative to the support, being placed higher than the deck and higher than the guidance and deflection means.

5. An apparatus according to claim 4, wherein said winch is situated close to a deck of the support in such a manner that the second line segment interconnecting said winch to said guidance and deflection means for the cable is close to said deck.

6. An apparatus according to claim 4, wherein said fixed structure is constituted by at least two guide rails on which said carriage moves.

7. An apparatus according to claim 4, wherein said carriage carrying said suspension means is driven in its displacement along the continuous structure by at least one traction cable guided by deflection pulleys from any drive means for said cable.

8. An apparatus according to claim 4, wherein said carriage includes a swinging motion compensator through which said cable passes.

9. An apparatus according to claim 4, wherein said carriage includes a device for orienting the load and through which said cable passes.

10. An apparatus for hoisting and handling loads from a maritime support having an edge, a winch disposed on the support, a guidance and deflection means disposed close to said edge of the support for receiving a cable of the winch and supporting a load coupled to an end of the cable, the apparatus comprising a gantry disposed on the support, the gantry having a carriage which includes a swinging motion compensator through which said cable passes, said carriage movable on at least two S-shaped guide rails by a winch driven cable, said cable coupled at one end to the carriage and extended over a deflection pulley disposed at a point B, and fixed at another end to said winch, said carriage movable along a path between a point A located over the support and the point B located overboard of the support, the point A being a point on the rails between the surface of the support and a cable path between the winch and the guidance means, and the point B is a point on the rails above the cable path between the winch and the guidance and deflection means, wherein the gantry does not support the load when the carriage is at the point A, and the gantry does support the load as the carriage is moved along a portion of the path away from the point A, and toward the point B, wherein said S-shaped guide rails include an extension beyond the overboard point B and extended alongside the support.

11. An apparatus for hoisting and handling loads from a maritime support having an edge, a winch disposed on the support, a guidance and deflection means disposed close to said edge of the support for receiving a cable of the winch and supporting a load coupled to an end of the cable, the apparatus comprising a gantry disposed on the support, the gantry having a carriage which includes a swinging motion compensator through which said cable passes, said carriage movable on at least two substantially linear guide rails of the gantry by a winch drive cable coupled at one end to the carriage, said cable extended over a deflection pulley disposed at a point B, and fixed at another end to said winch, said carriage movable along a substantially straight line path between a point A and said point B, wherein the point A is a point on the rails between the surface of the support and a cable path between the winch and the guidance and deflection means, and the point B is a point on the rails above the cable path between the winch and the guidance and deflection means, wherein the gantry does not support the load when the carriage is at point A, and the gantry does support the load as the carriage is moved along a portion of the path away from the point A, and toward the point B.

* * * * *

UNITED STATES PATENT AND TRADEMARK OFFICE

CERTIFICATE OF CORRECTION

PATENT NO. : 5,520,135

DATED : May 28, 1996

INVENTOR(S) : Yves Rolland, et al

It is certified that error appears in the above-indentified patent and that said Letters Patent is hereby corrected as shown below:

Title page, item [54] and col. 1, line 1 - 2, the title should read —METHOD AND APPARATUS FOR HOISTING HANDLING OF A LOAD AT SEA—

Signed and Sealed this

Tenth Day of September, 1996

Bruce Lehman

*Attest:*

BRUCE LEHMAN

*Attesting Officer*

*Commissioner of Patents and Trademarks*